US005722717A

United States Patent [19]

Rettenberger

[11] Patent Number: 5,722,717

[45] Date of Patent: Mar. 3, 1998

[54] PORTABLE SEAT WITH STORAGE COMPARTMENT

[76] Inventor: Randy C. Rettenberger, 2059 Sea Cove La., Costa Mesa, Calif. 92627

[21] Appl. No.: 612,746

[22] Filed: Mar. 8, 1996

[51] Int. Cl.[6] ..... A47C 7/62

[52] U.S. Cl. ..... 297/188.1; 297/188.13; 297/183.5; 297/52; 297/DIG. 6

[58] Field of Search ..... 297/DIG. 6, 188.09, 297/188.01, 188.08, 188.1, 46, 16.1, 440.11, 378.1, 217.1, 51, 52, 188.13, 183.5

[56] References Cited

U.S. PATENT DOCUMENTS

| | | | |
|---|---|---|---|
| D. 76,980 | 11/1928 | Bergstrom . | |
| D. 203,437 | 1/1966 | Melchior . | |
| D. 244,975 | 7/1977 | Steinberger . | |
| D. 277,813 | 3/1985 | Grady . | |
| D. 287,318 | 12/1986 | Garduno . | |
| D. 364,745 | 12/1995 | Rettenberger . | |
| 2,375,819 | 5/1945 | Reid | 297/188.08 X |
| 2,595,144 | 4/1952 | Isaacson | 297/188.09 X |
| 2,603,028 | 7/1952 | Roberts | 297/188.09 X |
| 2,727,564 | 12/1955 | Gruber . | |
| 3,077,327 | 2/1963 | Batie et al. | 297/188.01 X |
| 3,128,137 | 4/1964 | Dokter | 297/188.08 X |
| 3,290,089 | 12/1966 | Farnell | 297/188.1 X |
| 3,695,702 | 10/1972 | Ingellis | 297/440.11 X |
| 3,730,294 | 5/1973 | Thurmond | 297/188.1 X |
| 3,797,695 | 3/1974 | Law | 297/188.1 |
| 4,650,245 | 3/1987 | Nazar | 297/188.01 X |
| 4,773,709 | 9/1988 | Slinkard | 297/189.09 |

OTHER PUBLICATIONS

Camping & Fishing, 1955, p. 48, Carryall Stool, center page (as marked).

Design, Sep. 1976, p. 24, Folding Stool, Center right (as marked).

Sodibois Jardin, p. 3, Folding Stool. #312 center page (as marked).

Cabela's , 1987 Spring, p. 78, Folding Stool at bottom left.

Houtz & Barwick product, No. Carolina, published prior to Nov. 4, 1994. Photograph of Woodsman II™ chair, Coleman, Wichita, Kansas.

Photograph of Texsport Stool, Texport, Taiwan.

Photograph of Camping Stool, San Antonio Sports, U.S.A., San Antonio, Texas.

Photograph of Camping Stool, Manufacturing Unknown, Made in Taiwan.

*Primary Examiner*—Milton Nelson, Jr.

*Attorney, Agent, or Firm*—Knobbe, Martens, Olson & Bear, LLP

[57] ABSTRACT

A portable seat includes a storage compartment located beneath a seat cover of the seat. The seat cover of the seat normally extends between the legs of the seat to provide a seat surface. The seat cover, however, can be moved from this position to expose an access opening into the storage compartment. A user of the seat thus can access the storage compartment from the top side of the seat, easing access to the storage compartment.

26 Claims, 8 Drawing Sheets

PORTABLE SEAT WITH STORAGE COMPARTMENT

BACKGROUND OF THE INVENTION

1. Field of the Invention

The present invention relates in general to a portable seat. In particular, the present invention relates to a collapsible chair or stool which includes a storage compartment positioned beneath the seat of the chair or stool.

2. Description of Related Art

Many golfers change their shoes in the parking lot of a golf course. These golfers commonly lean against their car, sit on the bumper of their car, hop on one leg, or put their foot on the car when changing their shoes. These acts, however, often require sitting on dirty bumpers, squeezing between parked cars or leaving cleat marks on the car's exterior. Many golfers also find sitting on the bumper or leaning against the car when changing shoes uncomfortable and awkward.

Many golfers also leave their golf shoes in the trunk of their car, either loose or in their golf bag. If left loose, the golfer may have trouble finding both shoes, especially if the truck carries other items. If the golfer puts the shoes in a golf bag, the shoe may not receive proper ventilation and become malodorous.

SUMMARY OF THE INVENTION

The present portable seat addresses these problems faced by golfers when changing their shoes. The portable seat advantageously includes a storage compartment for storing the shoes. The storage compartment opens from the top of the seat to facilitate easy and convenient access into the storage compartment.

Although the present portable seat offers particular advantages to golfers, it also can be used in connection with a variety of other activities. For instance, the portable seat with its top-opening storage compartment can be used when hunting, fishing, attending sporting events, picnicking and engaging in like activities. The storage compartment provides an easily-accessed container for items and articles commonly used with these type of activities. The unitary design of the seat and the storage compartment also make it easy to carry.

In accordance with one aspect of the present invention, the portable seat includes a collapsible frame which defines a seat plane when open. A container is supported by the frame below the seat plane. The container has an upper opening which is accessible from above the seat plane. A seat cover is supported by the frame so as to lie generally within the seat plane and to cover the upper opening of the container. The seat is movable to expose the upper opening.

Another aspect of the present invention involves a portable seat comprising a first leg assembly and a second leg assembly. The first and second leg assemblies are movable from a folded position, in which the first and second leg assemblies lie generally adjacent to each other, to an opened position. In the opened position, at least a portion of the first and second leg assemblies are spaced apart from each other. A portion of the first and second leg assemblies defines a seat plane when in the opened position. A bag is positioned between the legs and includes an opening defined generally within the seat plane. A seat cover is coupled to at least one leg assembly and is movable from a closed position to a raised position. In the closed position, the seat cover extends between the corresponding portions of the first and second leg assemblies. In the raised position, the opening to the bag is exposed.

An additional aspect of the present invention involves a collapsible frame which supports a seat cover within a seat plane. A storage compartment depends below the seat cover and includes an access opening positioned beneath the seat cover. Means couple the seat to the seat cover such that the seat is movable to expose the opening to the storage compartment.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
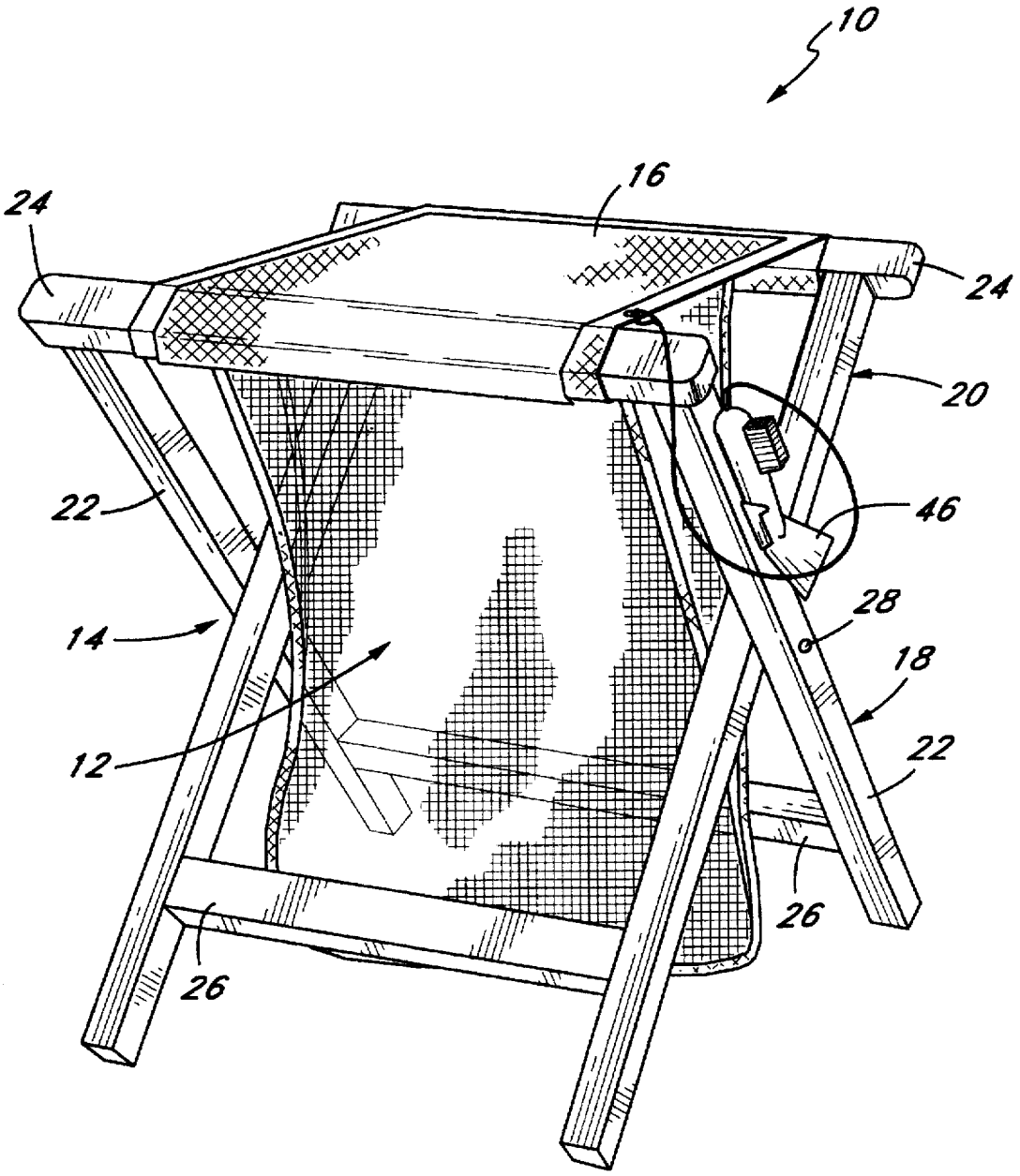
FIG. 1 is a front perspective view of a portable seat in accordance with a preferred embodiment of the present invention.

FIG. 1 illustrates a portable seat 10 with a bag or storage compartment 12 configured in accordance with a preferred embodiment of the present invention. This embodiment of the seat 10 is configured substantially in accordance with the portable seat design illustrated in U.S. Pat. No. Des. 364, 745, issued Dec. 5, 1995 to the application hereof, which is hereby incorporated by reference.

The seat 10 comfortably supports a person in a seated position at a conventional height (e.g., at a height of about 16 inches to 19 inches). The seat 10 also has a sufficient width (e.g., 10 inches) and a sufficient depth (e.g., 12 inches) for a comfortable feel.

The seat 10 advantageously has a durable, but lightweight construction which collapses to a compact state in order to be easily transported and stored. These features allow a person to readily use the seat 10 during a variety of activities such as, for example, when hunting, fishing, painting, changing golf shoes, attending sport activities or parades, or picnicking.

As seen in FIG. 1, the seat 10 principally includes a frame 14 which supports a seat cover 16 that extends across a portion of the frame 14. The frame 14 also supports the storage compartment 12 which lies between the legs of the frame 14 and below the seat 16. The individual components of the seat 10 will now be described in detail.

In the illustrated embodiment, the frame 14 includes two hinged leg assemblies 18, 20 which allow the seat 10 to fold flat; however, the collapsible feature of the seat 10 can be accomplished in any of a variety of ways readily known to those skilled in the art. The frame 14 also can include any number of legs or pedestals.

Figure 3:
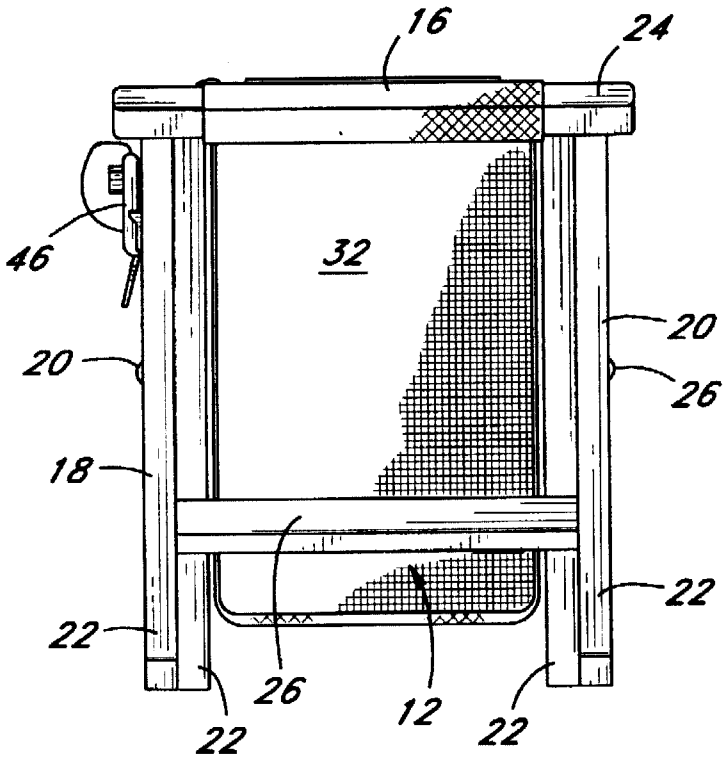
FIG. 3 is a rear side elevational view of the portable seat of FIG. 1.
Figure 2:
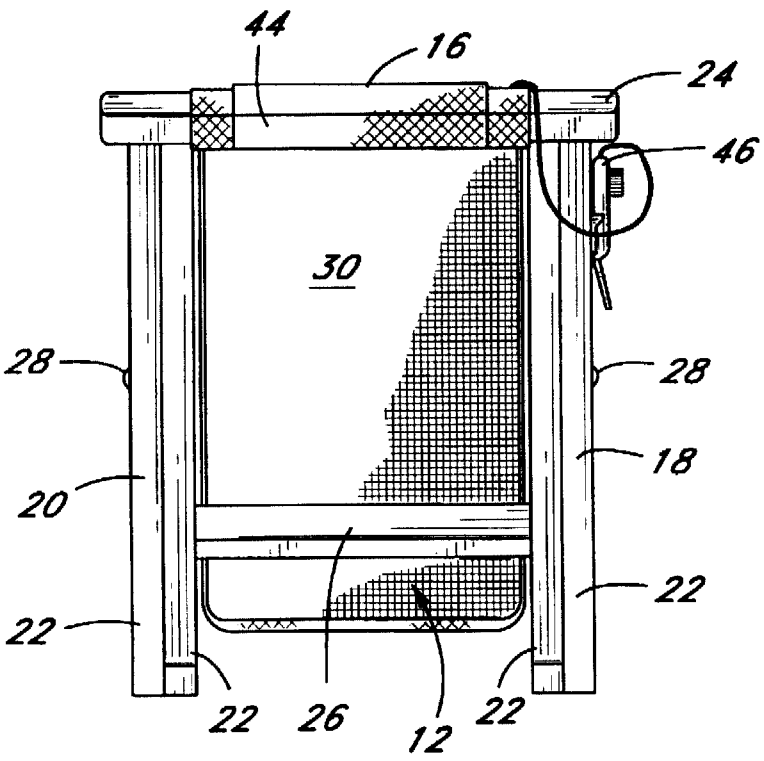
FIG. 2 is a front side elevational view of the portable seat of FIG. 1.

The front and rear leg assemblies 18, 20 are substantially identical, and therefore, the description herein of one will be understood as applying equally to both, unless specified to the contrary. As best seen in FIGS. 1 through 3, each leg assembly 18, 20 includes two legs 22 which are connected together at their top ends by an upper cross support 24. The legs 22 have a longer length that the height of the seat 10 in the opened position, and the upper cross support 24 is wider than the width of the seat cover 16. A lower brace 26 connects together the legs 22 at a point proximate to their lower ends. This configuration gives each leg assembly 18, 20 a generally inverted U-shape.

Each leg assembly 18, 20 desirably is constructed of a 1"×½" piece of hardwood. The legs 22, upper cross supports 24 and braces 26 are finished by rounding edges and are varnished for durability and appearance. The components of each leg assembly 18, 20 can be connected together by any of a wide variety of conventional means, such as, for example, by wood glue or screws.

Figure 4:
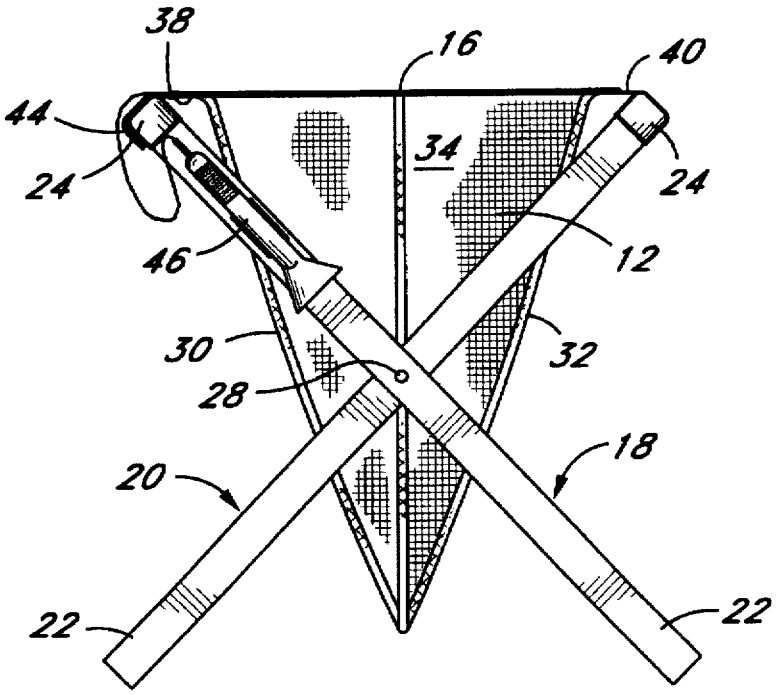
FIG. 4 is a right side elevational view of the portable seat of FIG. 1.
Figure 5:
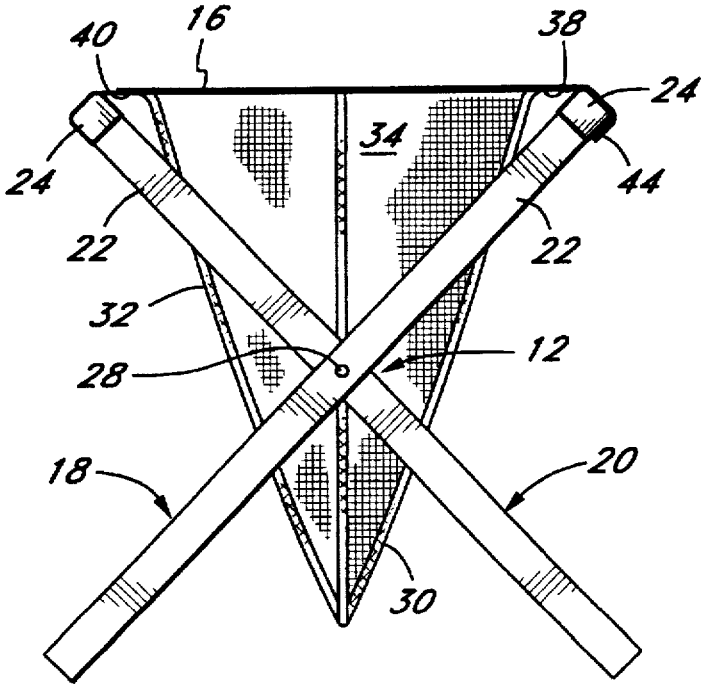
FIG. 5 is a left side elevational view of the portable seat of FIG. 1.

As best understood from FIGS. 1, 4 and 5, the leg assemblies 18, 20 are attached together by hinge couplings with the leg assemblies 18, 20 overlapping. The right leg 22 of the rear leg assembly 20 lies just inside a corresponding right leg of the front leg assembly 18. And the left leg of the front leg assembly 18 lies just inside the left leg of the rear leg assembly 20. A hinge pin 28 extends between the corresponding legs of the leg assemblies 18, 20 at about the longitudinal mid-point of each leg 22. In the illustrated embodiment, the hinge pin 28 desirably is a button head shoulder screw with a shoulder length equal to the combined length through the corresponding legs 22 of the front and rear leg assemblies 18, 20. In this manner, the legs 22 can smoothly pivot relative to each other.

The hinged construction allows the leg assemblies 18, 20 to move from a folded position to an open position. In the folded position, the legs 22 lie generally adjacent to one another. This presents a compact configuration. As seen in FIG. 1, the upper cross supports 24 can be spread apart from one another to open the legs 22. When open, the corresponding legs 22 of the leg assemblies 18, 20 give the frame 14 an "X"-like shape from the side with the upper cross supports 24 lying at a desired height (e.g., 16 inches to 19 inches).

As best seen in FIGS. 1, 4 and 5, the storage compartment 12 hangs between the upper cross supports 24 and extends down between the legs 22 and braces 26 of the frame 14. In the illustrated embodiment, as best seen in FIG. 3, the storage compartment 12 has a length generally equal to the length between the inner legs 22 of the front and rear leg assemblies 18, 20.

The storage compartment 12 can take a variety of different sizes and shapes depending upon the particular activity with which the seat 10 is design to be used. For instance, in the illustrated embodiment, the storage compartment 12 has a generally "V" cross-sectional shape of a sufficient width to receive a pair of golf shoes placed side-by-side in the storage compartment 12. The size and shape of the storage compartment thus can be tailored to suit any of a variety of applications of the portable seat 10.

In the illustrated embodiment, the storage compartment 12 is formed by front and rear panels 30, 32 which are sewn together along their bottom edge. The front and rear panels 30, 32 generally have rectangular shapes. Triangular-shaped side panels 34 are sewn to the side edges of the front and rear panels 30, 32 to complete the storage compartment 12.

Figure 6:
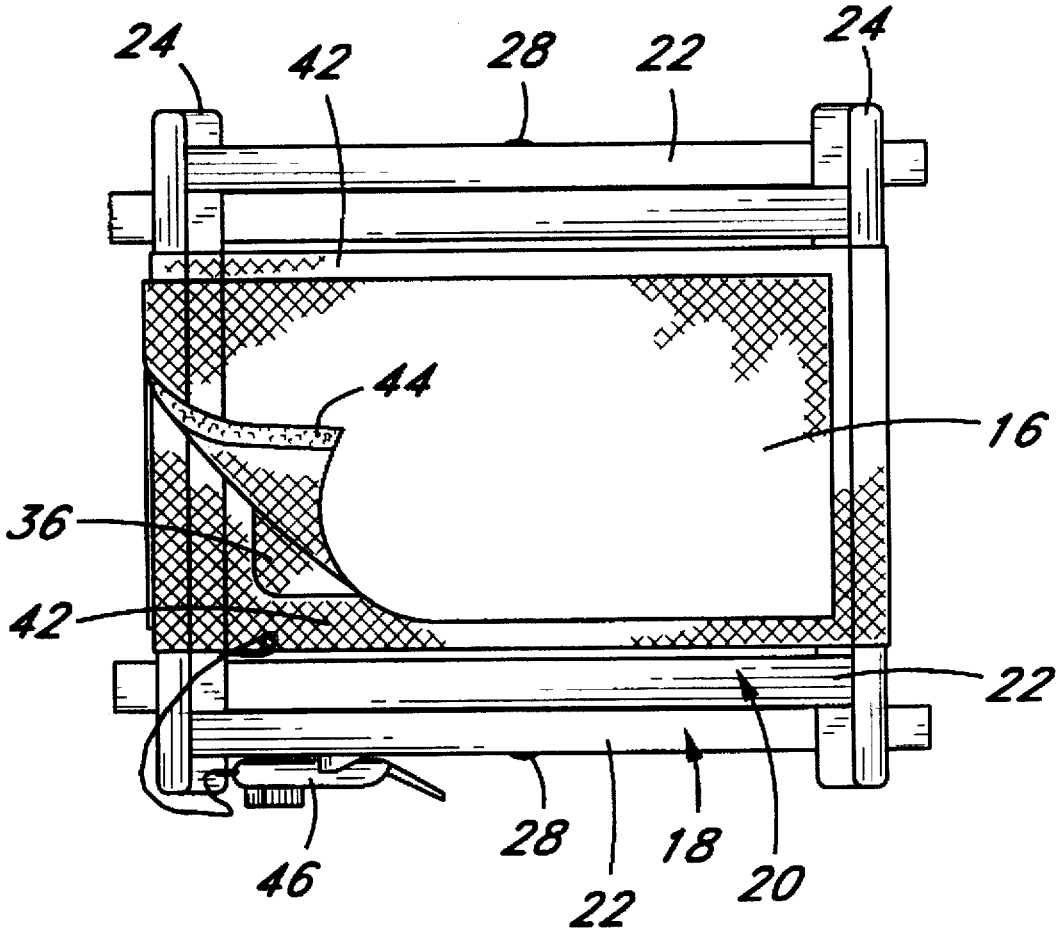
FIG. 6 is a top plan view of the portable seat of FIG. 1 with a top flap of a seat drawn to expose a portion of a storage compartment of the portable seat.

As understood from FIG. 6, the panels 30, 32, 34 of the storage compartment 12 define an opening 36 at an upper end of the storage compartment 12. The opening 36 generally has a rectangular shape and is sized smaller than the area defined between the upper cross supports 24.

Figure 7:
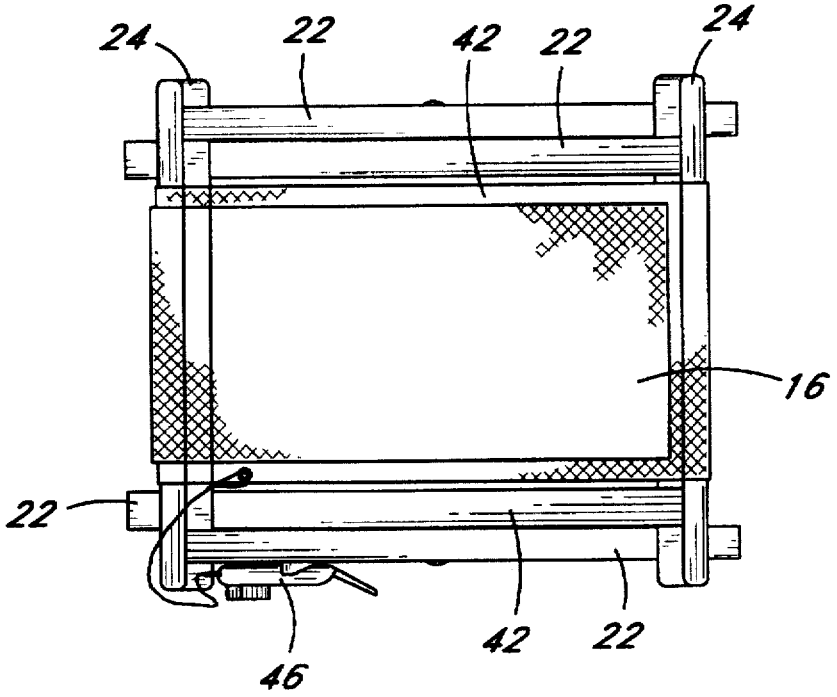
FIG. 7 is a top plan view of the portable seat of FIG. 1.
Figure 8:
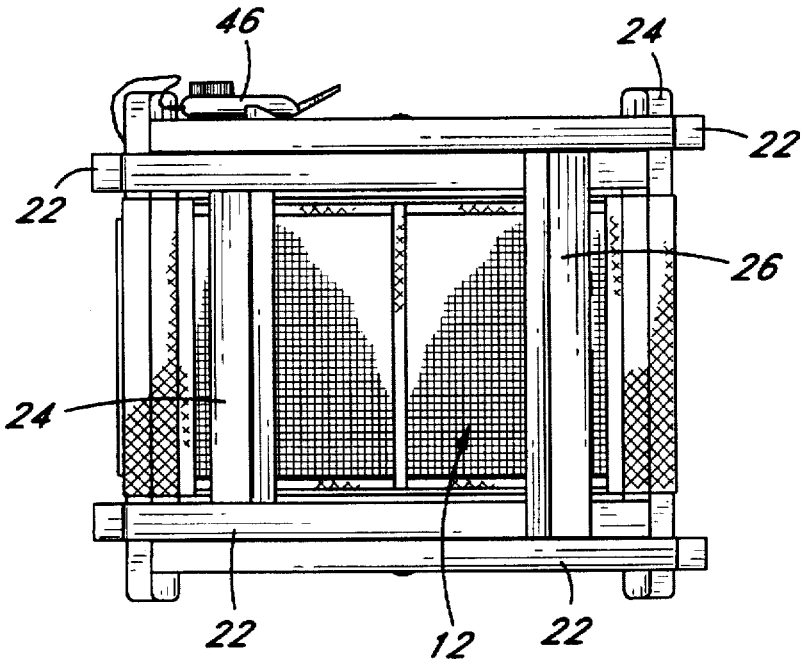
FIG. 8 is a bottom plan view of the portable seat of FIG. 1.

With reference to FIGS. 4, 5 and 7, attachment flaps 38, 40 extend from both the front and rear panels 30, 32 to facilitate attachment to the cross supports 24 of the frame 14. In the illustrated embodiment, the front flap 38 is wrapped around the outer edge of the front cross support 24 and is attached to the support 24 by conventional means. For example, an adhesive can adhere the flap 38 to the front cross support 24, or a fastener (e.g., a tack, staple, etc.) can attach the flap 38 to the cross support 24. Alternatively, the attachment flap 38 can form a loop and receive the upper cross support 24 of the front leg assembly 18. The rear attachment flap 40 also is attached to the rear cross support 24 in any of these manner.

As understood from FIG. 6, the upper opening 36 of the storage compartment 12 lies between the front and rear supports 24 with the flaps 38, 40 attaching the storage compartment 12 to the frame 14. In this position, the storage compartment 12 hangs down from the upper cross supports 24 between the legs 22 and braces 26 of the frame 14.

In the illustrated embodiment, the storage compartment 12 advantageously is formed of a breathable nylon mesh material which allows airflow through the bag. The storage compartment 12, however, can be formed of other lightweight, durable materials, such as, for example, a cotton or nylon canvas material. The material also can include a waterproof or water resistent coating.

A border desirably edges each of the sewn pieces of the storage compartment 12. The border preferably extends around the periphery of the storage compartment 12 and along each edge, finishing the edges of the storage compartment for a neat appearance and for preventing the panels from fraying and ripping. In an exemplary embodiment, the borders comprise nylon binding or tape folded in half with the edges of the panel positioned in the fold of the nylon binding.

As best understood in FIG. 7, the storage compartment 12 also includes side webbings 42 which extend between the front and rear flaps 38, 40 on either side of the storage compartment 12. The side panels 34 of the storage compartment are attached to webbings 42 for additional support and strength. In exemplary embodiment, the webbings 42 comprise an inch-wide nylon tape.

With reference to FIG. 1, the seat cover 16 generally has a rectangular shape of a sufficient size to extend between the upper cross supports 24 and to cover the opening 36 of the storage compartment 12. The seat cover 16 desirably attaches to at least one of the upper cross supports 24 in a releasable manner such that the seat cover 16 can be moved (i.e., raised) to expose the upper opening 36 of the storage compartment 12.

In the illustrated embodiment, the seat cover 36 is permanently attached to the rear upper cross support 24 and is releasably attached to the front upper cross support 24 when extended across the upper opening 36 of the storage compartment 12. The seat cover 16, however, can be releasably attached to both upper cross supports 24 so as to be completely removed from the frame 14 to expose the upper opening 36 of the storage compartment 12.

The seat cover 16 desirably is formed of a strong, durable material sewn to the rear flap 40 of the storage compartment 12. The seat cover 16, however, can be directly attached to the rear upper cross support 24 in a variety of ways, such as, for example, by an adhesive or a fastener (e.g., a screw, tacks, staples, etc.). As best seen in FIGS. 4 and 5, the seat cover 16 extends around the rear upper cross support 24 and over the upper opening 36 of the storage compartment 12. The loose front end 44 of the seat cover 16 is then coupled to the front upper cross support 24.

In the illustrated embodiment, a hook and loop type fastener, such as VELCRO® available commercially, attaches the front end 44 of the seat cover 16 to the front upper cross support 24. Other types of releasable fasteners, such as, for example, zippers, buttons, snaps, or the like, can be used to attach the front edge 44 of the seat cover 16 to the upper cross support 24; however, these fasteners do not provide the convenience and ergonomic attributes that the Velcro fastener provides.

A hook portion of the Velcro fastener is sewn to the front edge 44 of the seat cover 16 and the hook portion of the Velcro fastener is connected to the front upper cross support 24, either by sewing it onto the front flap 38 of the storage compartment 12 or by attaching it to the front cross support 24 by fasteners, such as, for example by staples or tacks. In an exemplary embodiment, the Velcro fastener has a length generally equal to the length of the storage compartment 12 and has a width of about 2".

The Velcro fastener securely attaches the front edge 44 of the seat cover 16 to the front upper cross support 24 with the seat cover 16 tautly stretched between the upper cross supports 24. The Velcro fastener provides sufficient strength to maintain the seat cover 16 in this position with an adult person seated on the seat cover 16.

The releasable connection between at least one edge of the seat cover 16 and the frame 14 allows the seat cover 16 to be moved to expose the upper opening 36 into the storage compartment 12. A user of the seat therefore can access the storage compartment 12 easily by releasing the end 44 of the seat cover 16 and pulling it back to expose the opening 36 of the storage compartment 12. The large opening 36 of the storage compartment 12 at its upper end allows easy access into the storage compartment 12, as well as allows the user to see the entire contents of the storage compartment 12 from above. The user therefore can drop items into the storage compartment 12 or remove items from the storage compartment from the upper side of the seat 10.

As seen in FIG. 1, the portable seat 10 desirably includes a cleat tool 46 attached to the frame 14 of the seat 10. A golfer can use the tool 46 to clean or tighten the cleats of his or her golf shoes when seated on the portable seat 10. The tool advantageously attaches to one of the frame legs 22 for storage.

FIGS. 9–13 illustrate a portable seat in accordance with another embodiment of the present invention. The portable seat illustrated in FIGS. 9–13 is substantially identical to the portable seat described above and illustrated in FIGS. 1–8. Therefore, the same reference numeral with an "a" suffix will be used to designate like components of the two embodiments for ease of understanding.

Figure 9:
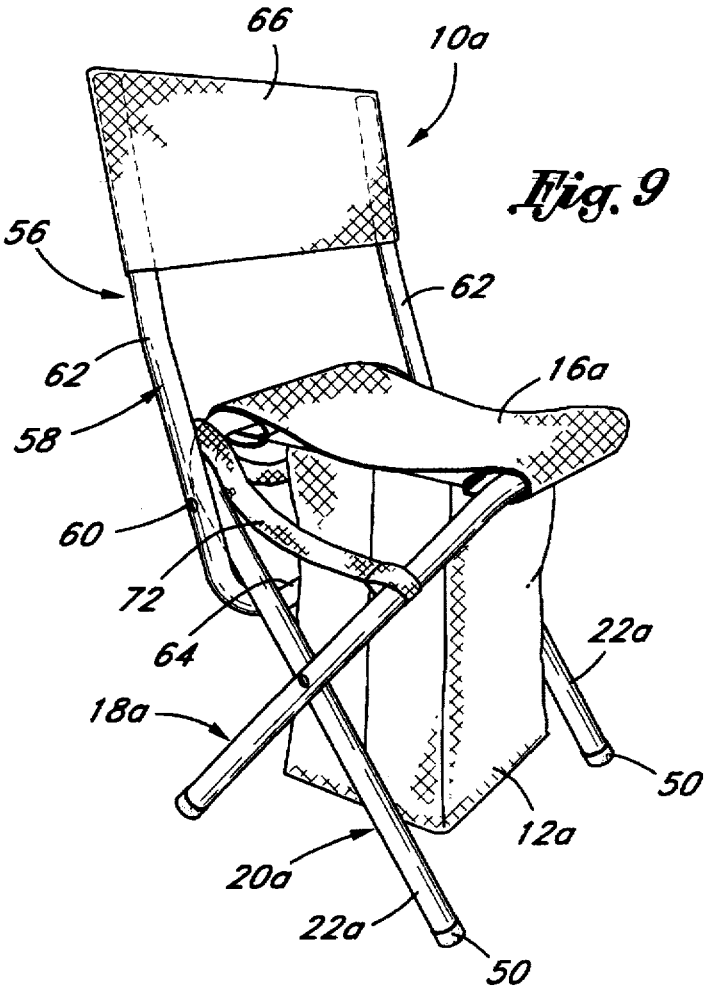
FIG. 9 is a front perspective view of a portable seat in accordance with another embodiment of the present invention.

With reference to FIGS. 9 and 19, the frame **14*a* includes front and rear leg assemblies 18*a*, 20*a*** are substantially identical, and therefore, the description herein of one will be understood as applying equally to both, unless specified to the contrary.

Each leg assemblies **18*a*, 20*a* generally has an inverted U-shape formed by an upper cross member 24*a* joining together two legs 22*a*. Although not illustrated, each leg assembly 18*a*, 20*a* can have an "O" shape formed by a bottom cross member joining together the lower ends of the legs 22*a* for improved ground support. In the illustrated embodiment, the leg assembly 18*a*, 20*a* is integrally formed of an aluminum tubing (e.g., 1" in diameter and 0.45" wall thickness) bent to form the legs 22*a* on the sides of the upper cross support 24*a*. A rubber tip 50 closes the end of each tubular leg 22*a***.

The leg assemblies **18*a*, 20*a* are attached together by hinge couplings with the leg assemblies 18*a*, 20*a* overlapping. A right leg of the rear leg assembly 20*a* lies just inside a corresponding right leg of the front leg assembly 18*a*. And the left leg of the front leg assembly 18*a* lies just inside the left leg of the rear leg assembly 20*a*. A hinge pin 28*a* extends between the corresponding legs 22*a* of the leg assemblies 18*a*, 20*a* about at the middle of the longitudinal length of each leg 22*a*. In the illustrated embodiment, the hinge pin 28*a* desirably is a bolt which passes through holes formed in the corresponding legs 22*a*. In this manner, the legs 22*a*** can smoothly pivot relative to each other.

Figure 11:
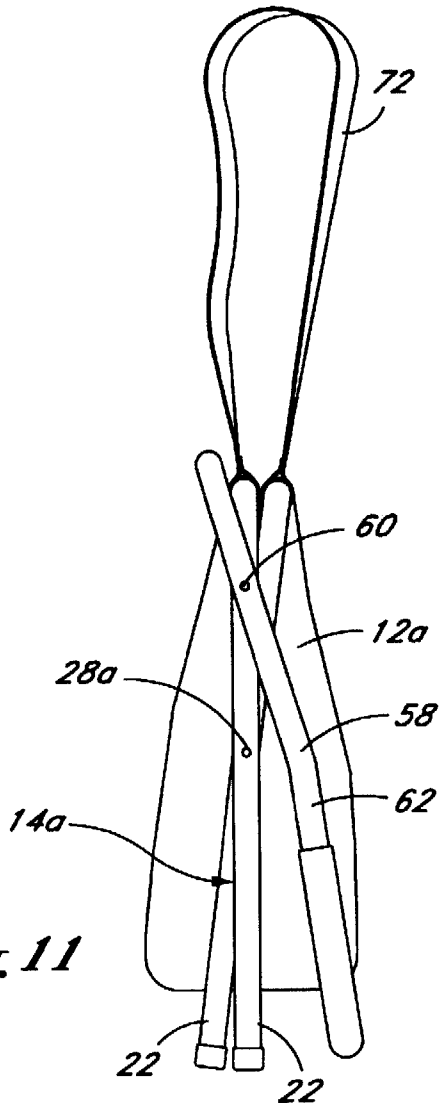
FIG. 11 is a side elevational view of the portable seat of FIG. 9 in a folded position.

The hinged construction allows the leg assemblies **18*a*, 20*a* to move from a folded position (see FIG. 11) to an open position (see FIG. 9). In the folded position, as seen in FIG. 11, the corresponding legs 22*a* of the leg assemblies 18*a*, 20*a* lie generally adjacent to one another. As seen in FIG. 9, the upper cross supports 24*a* can be spread apart from one another to open the legs 22*a*. When opened, the corresponding legs 22*a* of the leg assemblies 18*a*, 20*a* give the frame 14*a* an X-shape from the side with the upper cross supports 24*a*** lying at the desired height of the seat.

Figure 10:
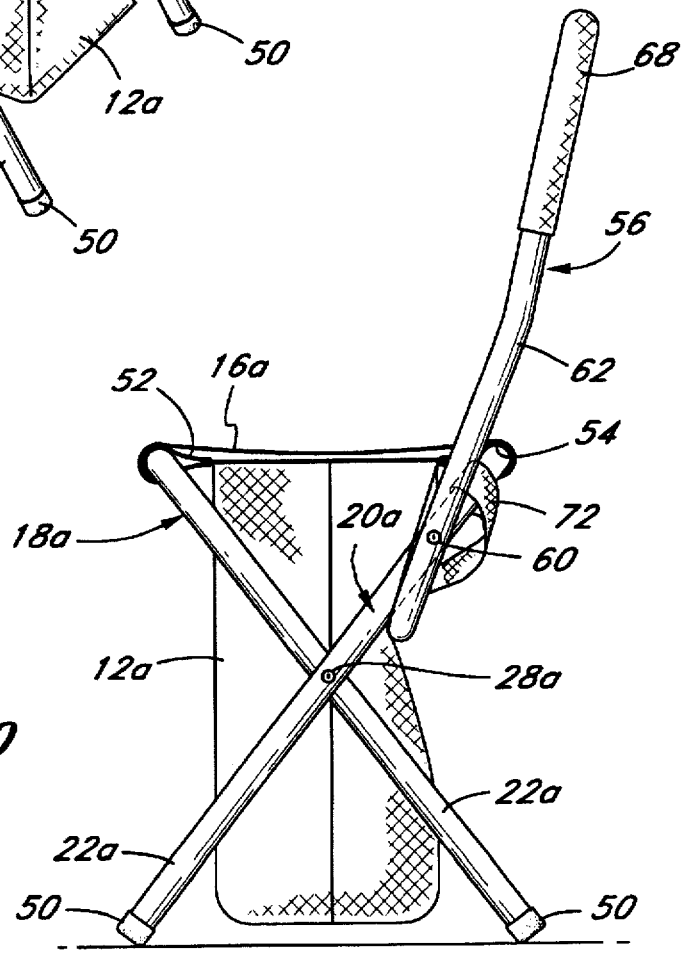
FIG. 10 is a right side view of the portable seat of FIG. 9.
Figure 13:
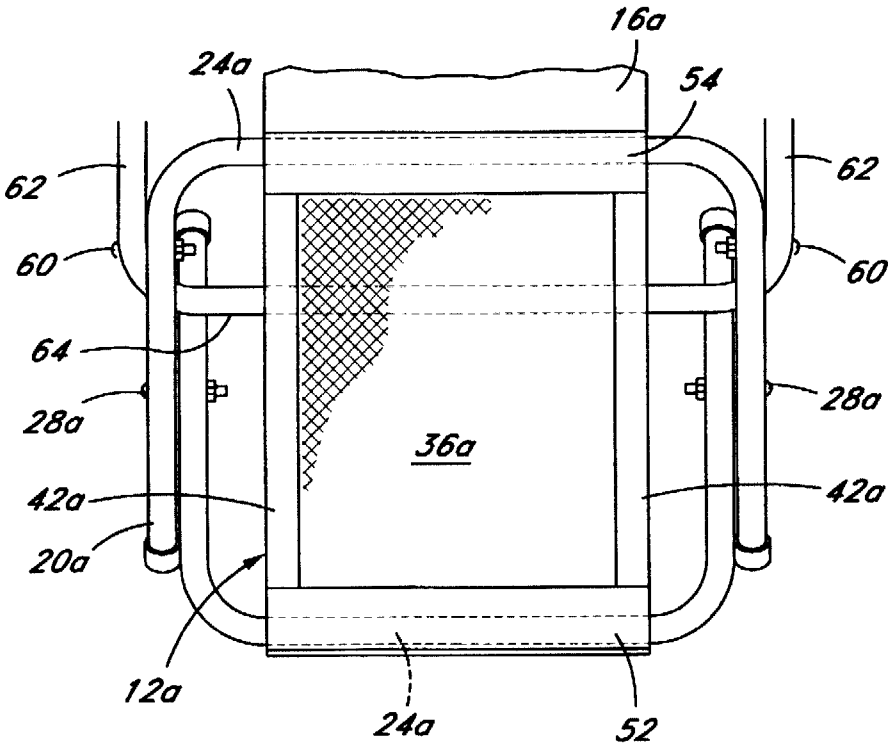
FIG. 13 is a partial top plan view of the portable seat of FIG. 12 taken in the direction of line 13—13.

As seen in FIGS. 9 and 10, a bag or container **12*a* hangs between the upper supports 24*a* and extends between the legs 22*a* of the frame 14*a*. In the illustrated embodiment, the container 12*a* generally has a rectangular shape constructed in a conventional manner. For instance, the storage container 12*a* can be formed of a single piece of material which is folded upon itself and sewn along its bottom and side edges. As best seen in FIGS. 10 and 13, side webbings 42*a* extend along and are attached to the upper side edges of the container 12*a***.

The walls of the storage container **12*a* defines an opening 36*a* at an upper end of the storage container 12*a*. The opening 36*a* generally has a rectangular shape and is sized smaller than the area defined between the upper cross supports 24*a***.

Although not illustrated, the storage container **12*a*** can include pouches or pockets on the outer sides of the container for additional storage. Zippers or snaps can releasably close the pockets.

Attachment loops 52, 54 are sewn to the upper ends of the storage container **12*a* on the front and rear sides of the storage container 12*a* and are attached to the webbings 42*a*. The loops 52, 54 are sized to receive the upper cross members 24*a* so as to support the storage container 12*a* between the legs 22*a* with the opening 36*a* of the storage container 12*a* positioned between the upper cross members 24*a***.

In the illustrated embodiment, the storage container 12a can be formed of a lightweight nylon material with a waterproof or water-resistant coating applied to one side (e.g., to the inner side) to waterproof the storage container 12a. Each webbing is a 1" wide nylon tape. The attachment loops 52, 54 advantageously are a lightweight, weaved, flexible material, such as, for example, a nylon or canvas cloth. In an exemplary embodiment, the attachment loops 52, 54 are desirably formed of a nylon 1000 Dinier Cordura which is available commercially from DuPont.

With reference to FIG. 9, the seat cover 16a generally has a rectangular shape of a size sufficient to extend between the upper cross supports 24a of the frame 14a and to cover the opening 36a of the storage container 12a. The seat cover 16a desirably attaches to one of the cross supports 24a in a releasable manner such that the seat cover 16a can be moved (i.e., raised) to expose the upper opening 36a of the storage container 12a.

In the illustrated embodiment, the seat cover 16a is permanently attached to the rear upper cross support 24a and is releasably attached to the front upper cross support 24a when extended across the upper opening 36a of the storage container 12a. The seat cover 16a, however, can be releasably attached to both upper cross supports 24a so as to be completely removed from the frame 14a to expose the upper opening 36a of the storage container 12a.

The seat cover 16a desirably is formed of a strong, durable material sewn to the rear support loop 54 preferably at the point where the storage container 12s is also attached. It is contemplated, however, that the seat cover 16a could be attached to this location by other means, such as, for example, by snaps, buttons, Velcro, or like fasteners.

As best seen in FIGS. 9 and 10, the cover 16a extends around the rear upper cross support 24a and over the opening 36a of the storage container 12a. The front end 44a of the seat cover 16a is then coupled to the front upper cross support 24a by a releasable fastener.

In the illustrated embodiment, a hook and loop type fastener (e.g., Velcro®) attaches the front side 44a of the seat cover 16a to the front upper cross support 24a. One component (i.e., either the hook portion or the loop portion) of the Velcro fastener is attached to the underside of the front support 24a and the other component of the Velcro fastener is attached to the underside of the front edge 44a of the seat cover 16a. When the seat cover 16a is pulled taut across the supports 24a, the front edge 44a of the seat cover 16a can be wrapped around and under the front edge of the front support 24a and pressed against the Velcro fastener component to secure the seat cover 16a in this closed position. This releasable connection between at least one edge of the seat cover 16a and the frame 14a allows the seat cover 16a to be moved to expose the upper opening 36a of the storage container 12a as described above.

The seat cover 16a desirably is formed of a nylon or cotton canvas material or duck. The edges of the seat cover 16a are under-mined or include borders to finish the edges of the seat cover 16a for a neat appearance and for preventing the edges of the seat cover 16a from fraying or ripping. In an exemplary embodiment, the seat cover 16a is formed of a nylon 1000 Dinier Cordura material having a waterproof or water-resistant coating applied to one side. The desired nylon Cordura material is commercially available from DuPont.

With reference to FIG. 9, the portable seat 10 also can include a backrest 56. In the illustrated embodiment, the backrest 56 is formed by an upper U-shaped frame 58 which is attached to the rear leg assembly 20a just below the upper cross support 24a. Hinge couplings 60 connects the backrest frame 58 to the seat frame 14a. In the illustrated embodiment, a bolt extends between each arm 62 of the backrest frame 58 and the corresponding leg 22a of the rear leg assembly 20a. This hinge connection allows the backrest 56 to be generally folded flat with the seat frame 14a in a closed position. As seen in FIG. 11, the arms 62 of the backrest frame 58 lie generally adjacent to the legs 22a of the rear leg assembly 20a when in the closed position for storage or transport. In a raised position, as seen in FIG. 9, the arms 62 extend vertically away from the seat cover 16a with a cross member 64 of the backrest frame 58 abutting the legs 22a of the rear leg assembly 18a. The contact between the cross member 64 and the legs 22a keeps the backrest frame 58 from pivoting back further.

With the backrest frame 58 in the raised position, a backrest member 66 extends between the extended arms 62. The backrest member 66 desirably has a width wider than the width of the seat cover 16a, and is constructed of the same material which forms the seat cover 16a.

In the illustrated embodiment, the backrest cover 66 is a rectangular pocket which slips over the upper ends of the arms 62 of the backrest 56. The upper end of the backrest member 66 is enclosed to capture the upper ends of the arms 62. In this manner, the backrest member 66 releasably attaches to the frame arms 62 in a set position. The backrest member 66 also can be removed from the arms 62 and placed in the storage container 12a when the seat 10a is collapsed.

Figure 12:
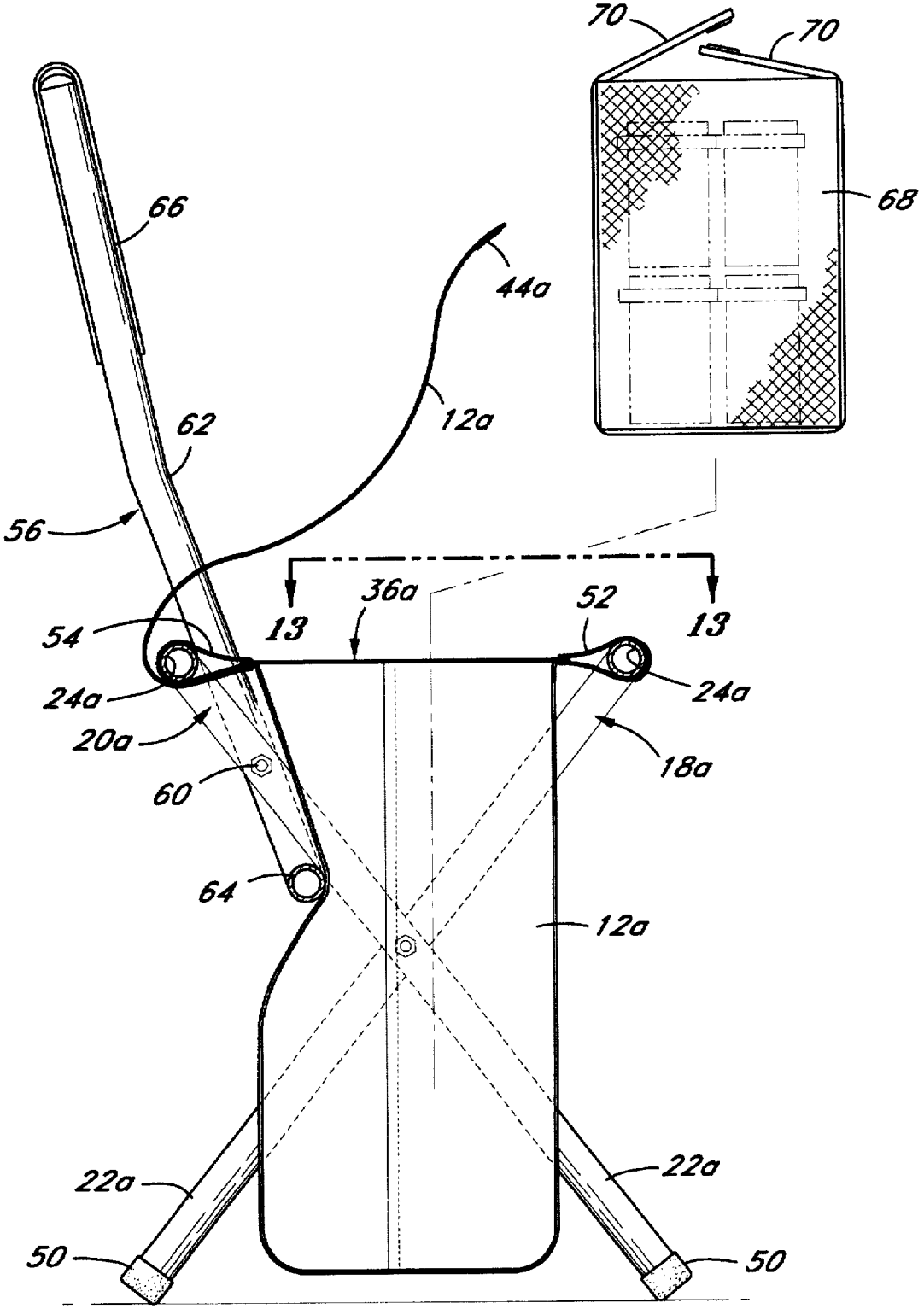
FIG. 12 is an enlarged, partially exploded and cross-sectioned, left side view of the portable seat of FIG. 9, illustrating the top flap drawn up and an inner container removed from a storage compartment.

With reference to FIG. 12, the portable seat 10a also can include a cooler 68 formed of an insulating material and sized to house a six-pack of canned beverages. The container 68 desirably has a rectangular shape which is sized to fit within the storage container of the seat. The cooler 68 includes upper flaps 70, also formed of an insulating material, which are attached together by Velcro. The upper flaps 70 allow access into the cooler 68 from the upper side of the cooler 68. In this manner, a person can access the cooler 68 positioned in the storage container 12a of the seat 10a without having to remove the cooler 68 from the seat 10a. Although the cooler 68 is illustrated and described as being separate and apart from the storage container 12a, it is contemplated that the storage container can be formed of an insulating material so as to integrate the cooler into the storage container.

As seen in FIG. 12, the portable seat 10a also includes a carrying strap 72. In the illustrated embodiment, the nylon strap 72 extends from the left side of the front leg assembly 18a to the right side of the rear leg assembly 20a, across the seat cover 16a. The carrying strap 72 is handy when the seat 10a is folded flat to allow the user to carry the seat 10a on his or her shoulder. However, as seen in FIG. 9, the strap 72 lies to the side of the seat cover 16a when the seat 10a is opened.

As common to both embodiments described above, a person accesses the storage compartment of the seat through the top of the seat. The person releases the front edge of the seat cover and raises the cover to expose the upper opening of the storage compartment. In this manner, the person can conveniently access the storage compartment and can easily view the contents of the storage compartment while standing above or kneeling beside the seat.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A portable seat comprising a collapsible frame which is movable between a collapsed position and an open position, said frame including a first support and a second support which define a seat plane with the frame in the open position, a container being supported by said first and second supports and depending into a space below said seat plane, said container having an upper opening accessible from above said seat plane, the opening being generally coextensive with a peripheral shape of the container just below the seat plane, and a seat cover attached to each support and positioned to lie generally within said seat plane and to cover at least a portion of said upper opening of said container, said seat cover being able to fold between and below the supports with the frame in the collapsed position and being releasably attached to at least one of the supports so as to be detached from the one support and moved toward the other support to expose generally the entire upper opening of the container.

2. A portable seat as in claim 1, wherein said seat cover completely covers said upper opening of said container.

3. A portable seat as in claim 1, wherein said seat cover comprises a material flap.

4. A portable seat as in claim 1, wherein said upper opening of said container is positioned between said first and second supports.

5. A portable seat as in claim 1, wherein a hook-and-loop fastener releasably attaches one side of said seat cover to one of said first and second supports.

6. A portable seat as in claim 1, wherein one side of said seat cover is permanently attached to one of said first and second supports.

7. A portable seat as in claim 1, wherein said frame additionally comprising a foldable backrest.

8. A portable seat as in claim 1 additionally comprising a cooler sized to fit within said container beneath said seat cover.

9. A portable seat as in claim 1, wherein said container is sized to receive a pair of adult-size shoes.

10. A portable seat as in claim 1, wherein said container comprises air openings to allow air flow through said container.

11. A portable seat as in claim 10, wherein said container is formed at least in part of a breathable mesh material.

12. A portable seat as in claim 1, wherein said frame comprises a plurality of legs, and at least one leg of said plurality of legs is connected to one of said first and second supports.

13. A portable seat as in claim 12, wherein said plurality of legs and said first and second supports together form a first leg assembly and a second leg assembly, each leg assembly generally having a U-shape defined by two legs interconnected by one of said first and second supports.

14. A portable seat as in claim 13, wherein said container is attached to said supports of said first and second leg assemblies and depends from the supports between said legs.

15. A portable seat comprising a first leg assembly and a second leg assembly, said first and second leg assemblies being movable from a folded position, in which said first and second leg assemblies lie generally adjacent to each other, to an opened position, in which at least corresponding portions of said first and second leg assemblies are spaced apart from each other and define a seat plane when in said opened position, a bag positioned between said leg assemblies and including an opening defined generally within said seat plane, the opening being sized to generally match the peripheral shape of the bag as defined within a plane parallel to and directly below the seat plane, first and second side links, each side link connecting together corresponding sides of the first and second leg assemblies, and a seat cover being movable from a closed position, in which said seat cover extends between corresponding portions of said first and second leg assemblies and covers said opening to said bag and at least a portion of each of the side links, to a raised position, in which said opening of said bag is fully exposed, said seat cover and said side links being able to fold between the leg assemblies when in said folded position.

16. A portable seat as in claim 15, wherein said seat cover comprises a flexible material.

17. A portable seat as in claim 15, wherein said seat cover completely covers said upper opening of said container with the seat cover in the closed position.

18. A portable seat as in claim 15 additionally comprising a foldable backrest attached to at least one of said first and second leg assemblies.

19. A portable seat as in claim 15 additionally comprising a cooler sized to fit within the bag.

20. A portable seat as in claim 15, wherein the bag includes means for ventilating an interior of the bag.

21. A portable seat as in claim 20, wherein said bag is sized to receive a pair of shoes.

22. A portable seat as in claim 15, wherein a first upper cross support connects together a plurality of legs of said first leg assembly and a second upper cross support connects together a plurality of legs of said second leg assembly.

23. A portable seat as in claim 22, wherein said first and second leg assemblies each generally have a U-shape defined by the legs of and the respective upper cross support.

24. A portable seat as in claim 22, wherein said seat cover is releasably attached to one of said first and second upper cross supports.

25. A portable seat as in claim 24, wherein a hook-and-loop fastener releasably attaches one side of the seat cover to one of the first and second upper cross supports.

26. A portable seat as in claim 25, wherein one side of the seat cover is permanently attached to one of the first and second upper cross supports.

* * * * *